US005375659A

United States Patent [19]

Gilbert et al.

[11] Patent Number: 5,375,659

[45] Date of Patent: Dec. 27, 1994

[54] SONDE SUPPORTED OPERATING SYSTEM FOR CONTROL OF FORMATION PRODUCTION FLUID FLOW

[75] Inventors: Gregory N. Gilbert, Missouri City; Martin L. Tomek, Houston; William B. King, Houston; Jerry R. Bennett, Houston; Perry C. Shy, Arlington; William R. Welch, Carrollton, all of Tex.

[73] Assignee: Halliburton Logging Services Inc., Houston, Tex.

[21] Appl. No.: 239,950

[22] Filed: May 9, 1994

Related U.S. Application Data

[63] Continuation of Ser. No. 158,715, Nov. 24, 1993, which is a continuation of Ser. No. 957,963, Oct. 8, 1992.

[51] Int. Cl.[5] ..... E21B 49/00

[52] U.S. Cl. ..... 166/264; 166/162

[58] Field of Search ..... 166/264, 162, 169, 58, 166/59, 381, 382, 386, 387

[56] References Cited

U.S. PATENT DOCUMENTS

| | | | |
|---|---|---|---|
| 3,051,243 | 8/1962 | Grimmer et al. | 166/224 |
| 4,436,152 | 3/1984 | Fisher, Jr. et al. | 166/214 |
| 4,483,543 | 11/1984 | Fisher, Jr. et al. | 277/188 |
| 4,580,632 | 4/1986 | Reardon | 166/264 X |
| 4,630,833 | 12/1986 | Boyle et al. | 277/188 |
| 4,896,721 | 1/1990 | Welch | 166/214 |
| 4,940,088 | 7/1990 | Goldschild | 166/264 X |

OTHER PUBLICATIONS

Brochure: Otis®: The Technology Leader for Sliding Side-Door® Devices ©1991 Otis Engineering Corporation.

*Primary Examiner*—Michael Powell Buiz

*Attorney, Agent, or Firm*—Arnold, White & Durkee

[57] ABSTRACT

The present disclosure is directed to an apparatus which can be installed for opening and closing fluid flow production from a formation penetrated by a cased well borehole and connected therewith through perforations. The production tubing string is installed with a moveable sleeve having a closed and open position. The moveable sleeve defines a controllable pathway into the production tubing string. In conjunction with that, there is an internal receptacle formed in the production tubing string to enable landing of a sonde there at. The sonde connects firmly at the receptacle. Similarly, the moveable sleeve in the production tubing string has a receptacle it in which enables unique landing of a latching mechanism, the latching mechanism extending along the axis of the production tubing string at the urging of a motor in said sonde. The motor operates an elongate extendible member to move the sleeve from the closed to the open position and back. Suitable valves, passages and containers affiliated with the sonde can be used to capture samples or to otherwise control production.

31 Claims, 12 Drawing Sheets

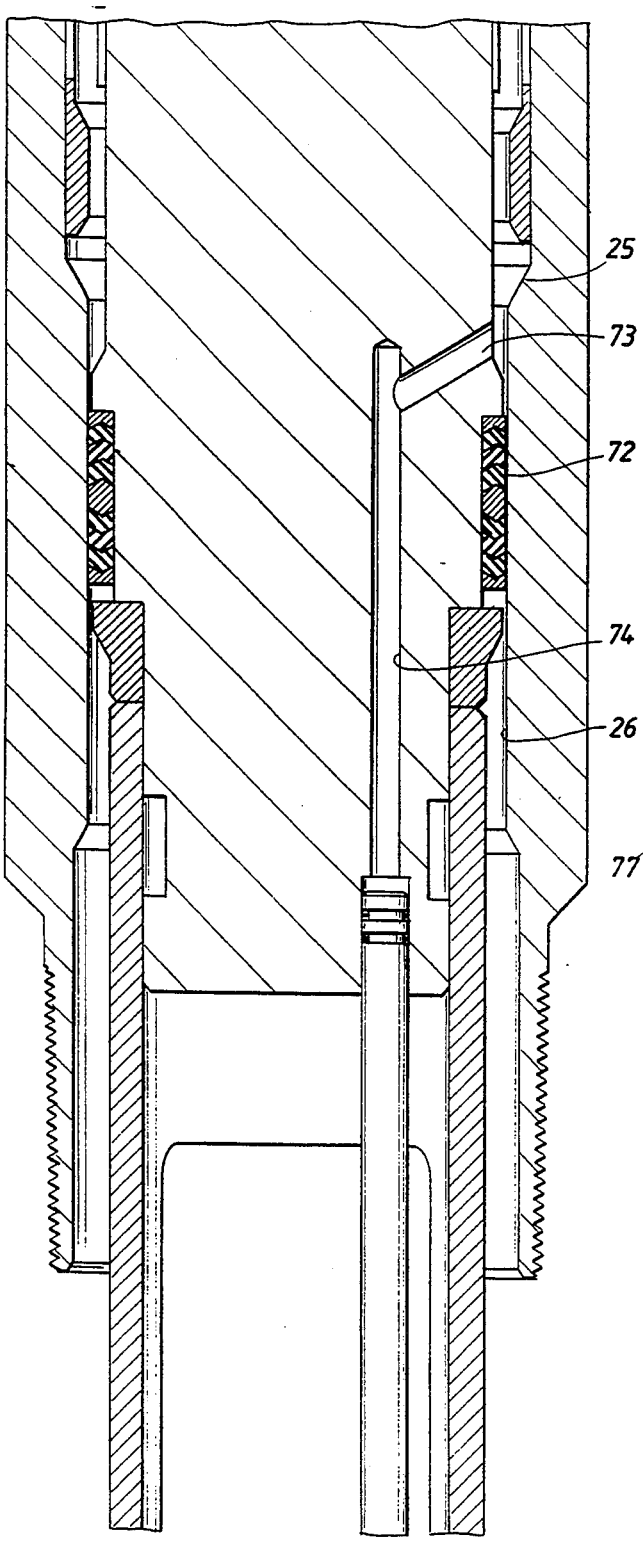
FIG. 2H
FIG. 2I
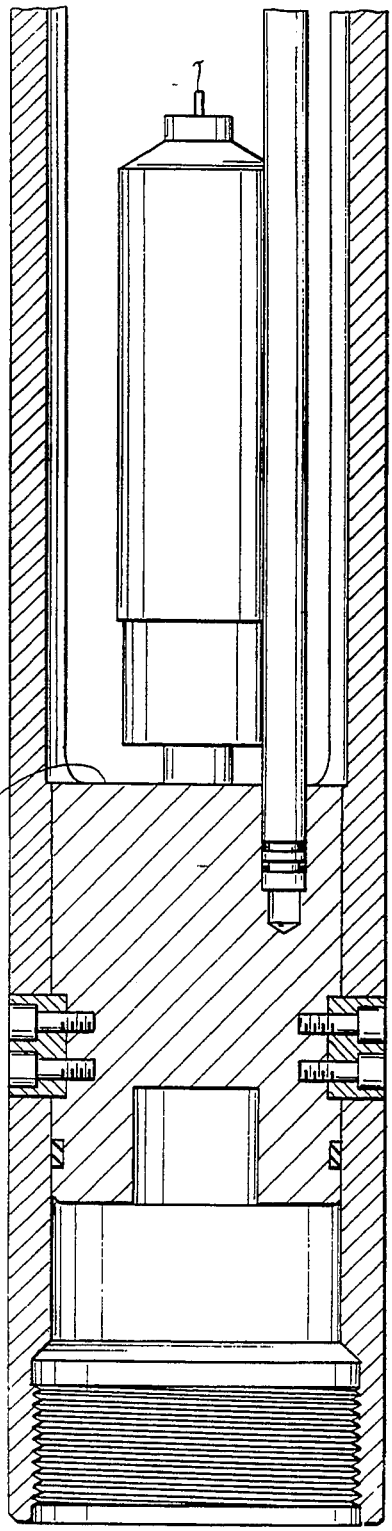

SONDE SUPPORTED OPERATING SYSTEM FOR CONTROL OF FORMATION PRODUCTION FLUID FLOW

This application is a continuation of Ser. No. 08/158,715, filed Nov. 24, 1993, which is a continuation of Ser. No. 07/957,963, filed Oct. 8, 1992.

BACKGROUND OF THE DISCLOSURE

This disclosure is directed to a system for initiating and ending formation fluid flow in a plurality of formations intercepted by a well borehole. Two or three examples of this type of well will suffice to describe and set the stage for the equipment of this disclosure. Consider as an example a cased well borehole which passes through three or four production zones. One mode of production is to case the well, form perforations into the separate multiple formations where production is obtained, and produce each zone into an isolated zone in the well borehole. That is, a packer is placed above and another placed below the zone so that zone production is isolated in the region of the particular zone. Production is removed from the zone by means of a production tubing string dedicated to that particular zone. This is somewhat complicated in that each zone has its own production tubing string and accordingly, the top zone is isolated by packers which must permit the production tubing strings of the lower zones to pass through; this requires a relatively complex completion procedure. If there are three production zones of interest, the packers for the top zone will connect with only one tubing string but the production tubing for the lower two formations will pass through, creating a relatively complex packer installation at the top zone. The bottom most zone of course remains relatively simple.

One choice that is not a choice at all is to permit all the zones to flow into a production tubing string without zone or formation isolation. This can be done provided a single production sand is isolated at different elevations in the well; however, it is generally undesirable to do this because there are differences in production rates from the zones. In part, this stems from the fact that the zones may have different pressures. Indeed, it is possible for one zone to produce because it has a high pressure drive into the cased well and yet another zone may steal production because it has a relatively low production rate into the well. In that instance, production from the high pressure formation may have sufficient pressure drive that the production fluid is driven from the high pressure formation into the well and out of the well because it flows into the formation which has a comparatively reduced pressure drive.

Another example of this problem derives from the water that is commingled in various production zones in an oil field. For instance, there may be a first sand which has high pressure with no water mixed with the oil. There may be a second formation where the oil is floating on top of produced water. The produced water can be fresh water or salt water. There may be other sands or formations where there are known water drives which provide produced water at various times in the produced formation fluids. It is usually undesirable to commingle water from the different formations. It is undesirable because the water in one formation may be fresh water and the water in another formation may be salt water. It is also undesirable because there may be sufficient differences in the water pressures that the high pressure formation will deliver water at such a volume and pressure that it forces into the low pressure formation. It is therefore generally undesirable that water as well as hydrocarbon or petroleum products be produced and commingled in a well borehole merely by directing perforations into a multitude of formations and delivering the formation fluid flow into a commingled zone in the cased well.

In testing for produced water purity, and in particular in testing for any type of pollutant that may be carried by an artesian sand, it is desirable that individual sands be isolated. Thus, a well which passes through several water producing formations is preferably isolated at each formation. This isolation enables fluid production to be obtained for instance if there were four formations of interest which required perforation, each of the four could be produced for one day and shut in for the next three days while the others are then produced. Alternately, it may be desirable to produce for just a short interval from each of the formations to obtain a test sample. In that instance, the test sample need only be a small sample or lot, perhaps a fraction of a liter. In a variety of circumstances, one can imagine why it is necessary to produce from a single formation into a well borehole, isolate that production and deliver that production fluid for testing or assay purposes. In any case, a number of variations can be implemented through the use of the present equipment so that a small sample isolated from commingling with other fluids from other formations is delivered. In one instance, it may be production for a week from a single formation while in another instance, it can be production of only a fraction of a liter. Commingling is prevented during production and also at the start and finish of production. Moreover, this enables surface control of the particular formation fluid so that such isolation is subject to control at the well head.

The present apparatus cooperates with a cased well borehole in which the cased well is cemented in place in the ordinary fashion and perforations are formed into the producing formations of interest. Production fluid flow is delivered from a particular formation into a set of perforations which flow into a plugged casing for production into a packer defined zone connected to a production tubing. The tubing includes a special joint which is installed at that region. This particular tubing joint has a outer cylinder which functions in the ordinary fashion to define the tubing string in the cased well borehole. On the interior, this particular tubing joint has, from the upper end, an anchor receiving receptacle. This profiled receptacle is an anchor for a tool that will be described to enable the tool to be anchored with certainty in the receptacle. The receptacle is cut with a set of encircling rings and shoulders which conform with and cooperate with mating keys which extend radially outwardly into the anchor receptacle. Below that, there is a polished cylindrical area. It cooperates with a seal that will be described. Below that, there is a movable sleeve which has a receptacle on the interior face of it. This receptacle is unique in its ability to accept only one type of key mechanism which inserts into it. The sleeve is in the up position initially to receive the unique, matching, profiled keys on the sonde. This enables latching to the sleeve. The sleeve has slots in it to permit production fluid to flow into an isolated zone in the well; the sleeve is immediately adjacent to upper and lower sleeve seal rings which define an area or region which is isolated. When the sleeve moves downwardly, the slots are positioned between the upper and lower seals so that the movable sleeve then opens the fluid flow pathway. So to speak, this sleeve functions as a control valve mechanism. It is a sliding sleeve functioning as a valve permitting formation fluid flow from the formation and through perforations in the casing member which is cemented in place at the formation of interest. The fluid flow is valved to enable flow into the production tubing. As noted, there are upper and lower seals which are adjacent to the moveable sleeve. The moveable sleeve is able to slide downwardly so that it can be moved from the initial closed condition into the open condition or position. There is another polished cylindrical area to receive a second seal for purposes to be described.

This moveable sleeve equipment is installed at each of the formations of interest in a production tubing for the formation. This type of equipment is installed so that the production control is initiated by the present apparatus which further includes a sonde which is lowered in a well borehole on an electric line. The line provides sufficient conductors to provide electrical power for operation and also has conductors for providing signals to operate specific valves in the apparatus. Moreover, it incorporates an electrical conductor pathway through the sonde which enables the conductors to connect with pressure isolation so that the electrical conductor pathway is protected from the intrusion of fluid. In addition to that, there is an externally located sleeve on the sonde which supports at its lower extremity a set of latch keys which extend into the anchor receptacle previously described that is located in the tubing joint. These keys are supported in a surrounding cage, and are able to extend radially outwardly through the window so that locking is accomplished, that is, where the keys fit into and match up with the profile in the anchor receptacle. This sleeve is telescoped in downward movement, the movement being sufficient to achieve radial extension outwardly of the keys in the anchor position. On the sonde interior, there is an electric motor controllably operated from the surface which connects with a lead screw on the interior. That screw supports a traveling nut, which, on screw rotation, is driven downwardly. The traveling nut has a stroke length which is sufficient to set into motion several sequential steps or movements involved in opening the moveable sleeve that is between the sonde and the production in the well borehole.

The moveable sleeve serves as a control valve as mentioned. The traveling nut which is advanced by the motor engages the top end of the sleeve by forcing it to move downwardly. Before that however is accomplished, there is the necessity of assuring connection with the sleeve by means of a coacting receptacle on this moveable sleeve in conjunction with latch keys forced radially outwardly into the receptacle. This receptacle on the moveable sleeve along with the receptacle thereabove assures that connection is made by the sonde at two locations, one to the moveable sleeve and the other to the tubing joint. The latch keys are extended radially outwardly into the receptacle on the moveable sleeve to make sure the connection. This is accomplished on the downward travel of the traveling nut and sleeve which repositions the slots in this moveable sleeve adjacent to the perforations into the formation so that formation fluid flow is received. Downward travel of this sleeve is extended until the sleeve locks at a desired location after travel.

The exterior of the sonde supports upper and lower seals which line up with particular polished cylindrical areas of the tubing joint to define an isolation zone. From the interior of the sonde, there are ports cooperative with passages extending along the length of the sonde. The passage conveniently extends towards the end of the sonde for communication with an electrically operated control valves. In one embodiment, control valves permit downward flow of fluid in the isolation zone into a first container, and there is a second container which is also filled through the same pathway. Briefly, one container in a preferred embodiment can be used to hold and store waste sample. This is the sample that is in the isolation zone defined between the sonde and the moveable sleeve prior to opening of the sleeve, and as desired, sample which is accumulated there after closing of the sleeve. There is a second container which can be used to store the pure sample directly flowing from the formation into this chamber or container.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Attention is directed to FIG. 1 of the drawings. In FIG. 1, the equipment that is part of the production tubing in the cased well borehole will be described first and then the description will discuss the sonde of the present invention. This invention includes a sonde 10 which is adapted to be lowered into a well borehole equipped with the moveable sleeve to be described. The equipment 10 will not be described until the cooperating equipment in the cased well is described and its mode of operation is understood. It is important to note the nature and operation of the installed equipment because it is the equipment operated by manipulation of the sonde 10. To this end, the well can be any depth and vertical, but it also can be a deviated well so that the well is at an angle or even horizontal. In light of well completion techniques now in vogue, the present apparatus can be used in a vertical segment of the well or in a segment which is substantially horizontal. By pinning the outer sleeve this apparatus has the advantage of operating even in the horizontal mode because it does not depend on gravity for its power. The well is presumed to pass through at least two, sometimes more, production zones which produce formation fluid of interest. The formation fluid typically may be petroleum production as well as water. It may be only petroleum or it may be only water depending on the age and life of the well as an example. It may pass through three or four zones and each zone is equipped with the equipment that will be described momentarily. Without regard to the nature of the fluid, that is, whether it is oil mixed with water, pure water, salt water or any other fluid, it is produced through the equipment to be described from one formation at a time. For easy description, assume that the present well passes through two such formations, and one of the formations produces fresh water and the other formation produces salt water at a much higher pressure drive. The formation that produces salt water may on occasion produce oil which is carried with the salt water production. In these instances, this describes a well where the formations cannot be directly communicated along the cased well. That is, the formations must be isolated.

Figure 1A:
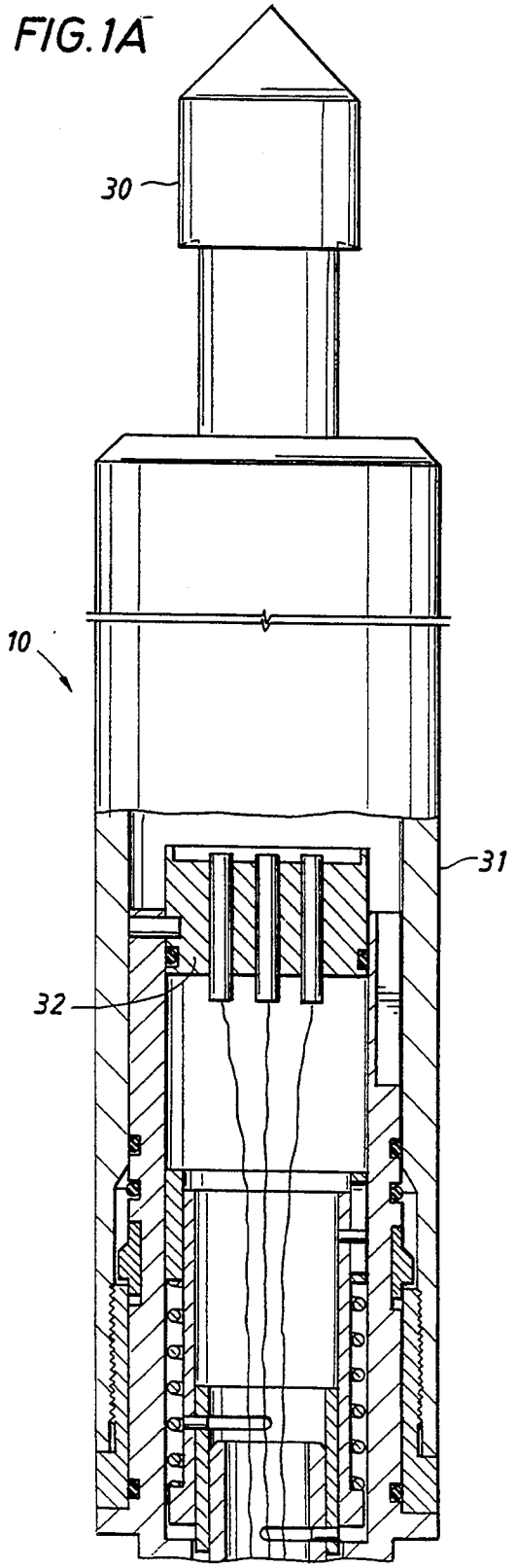
FIG. 1 (serial segments 1A, 1B, 1C, 1D, 1E, 1F, 1G, 1H and 1I) is a view showing the cased well production tubing provided with a tubing joint which supports a pair of internal seals and a moveable sleeve so that production from the formation is controlled by flow through the sleeve, and the sleeve is further provided with slots therein which are controllably moved into alignment to permit such production, and FIG. 1 also shows the sonde of the present apparatus in location for controllable connection to the sleeve.
Figure 1B:
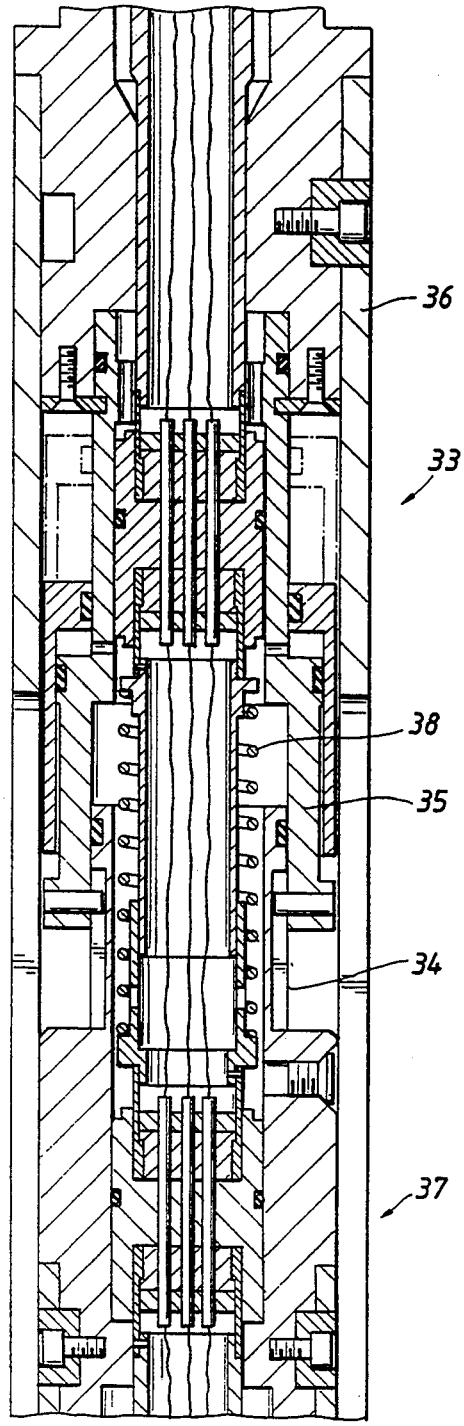
Figure 1C:
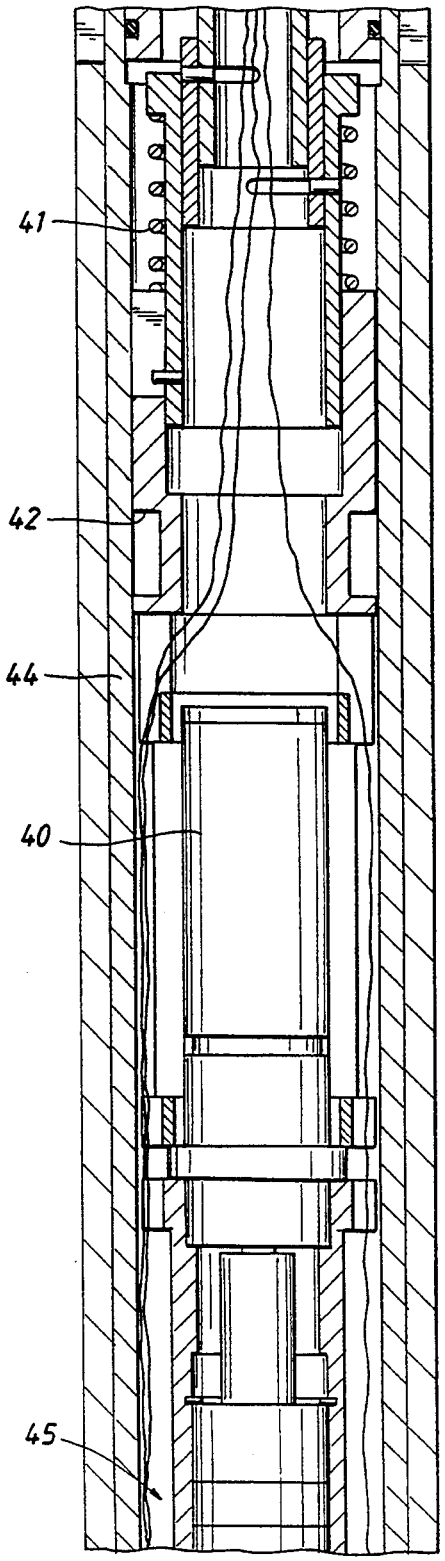
Figure 1D:
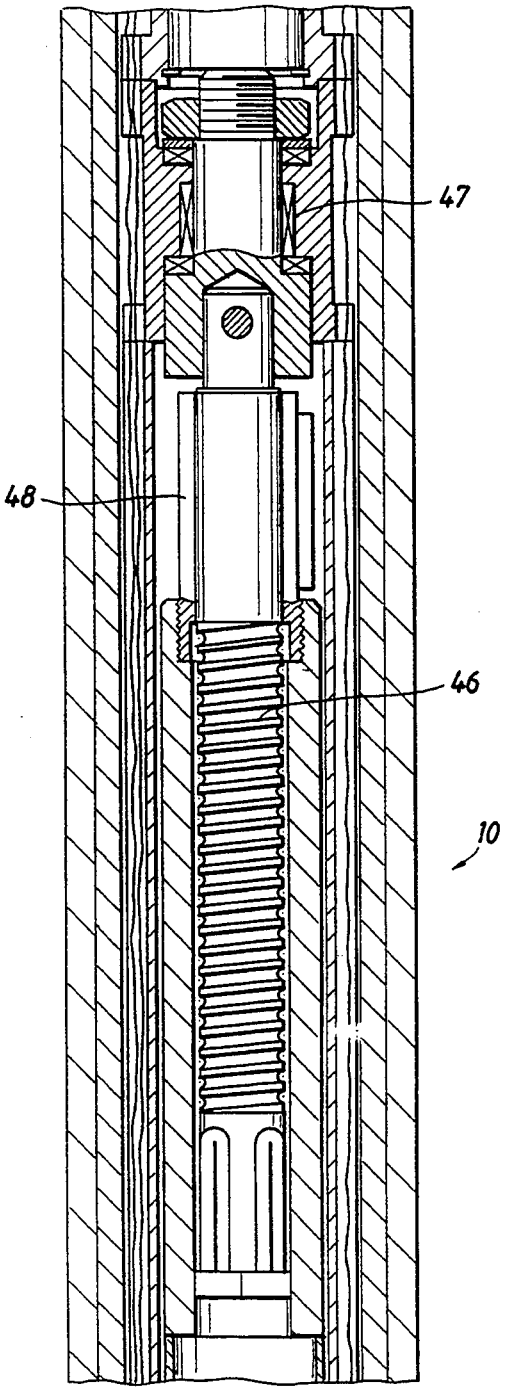
Figure 1E:
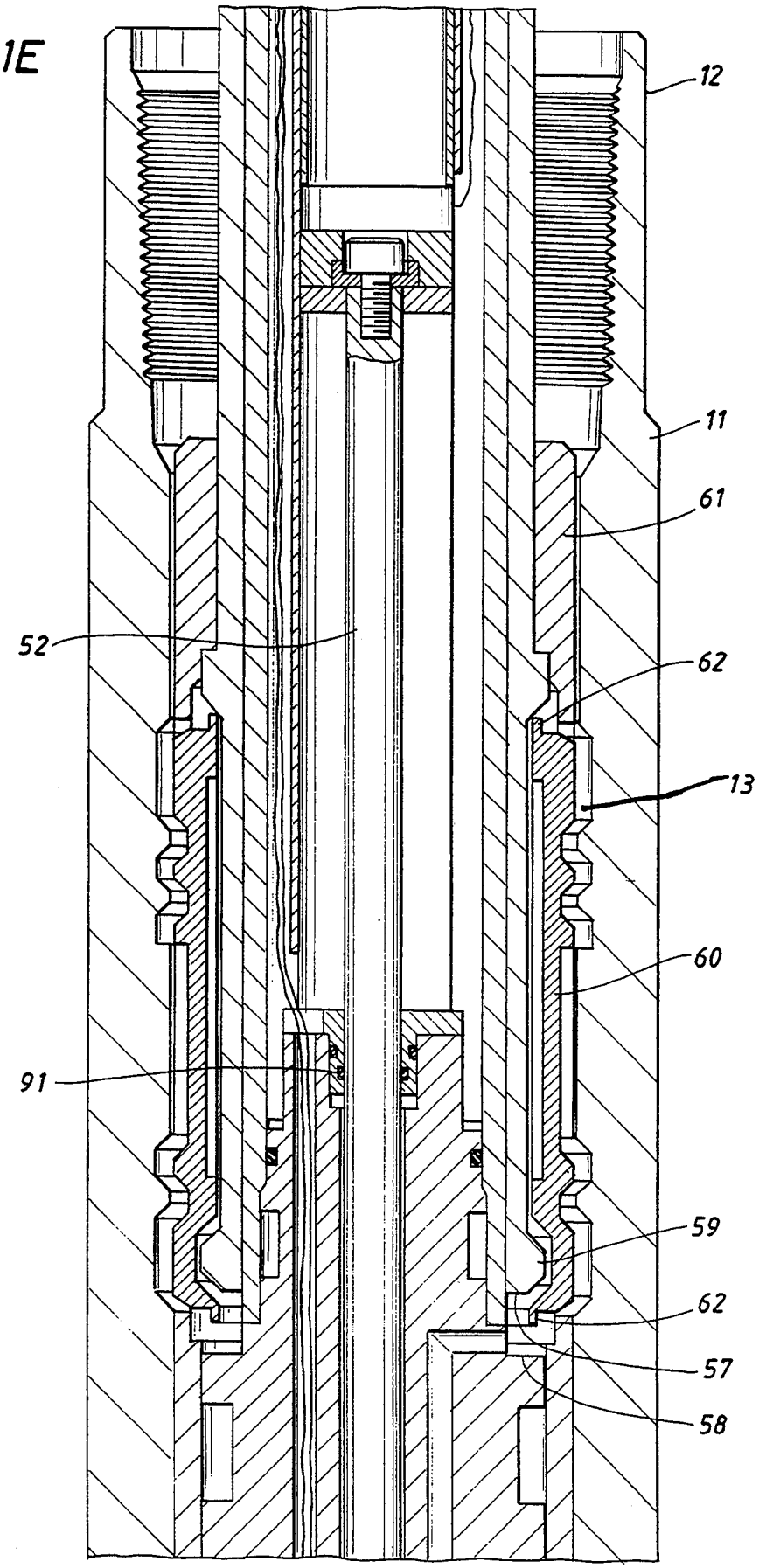
Figure 1F:
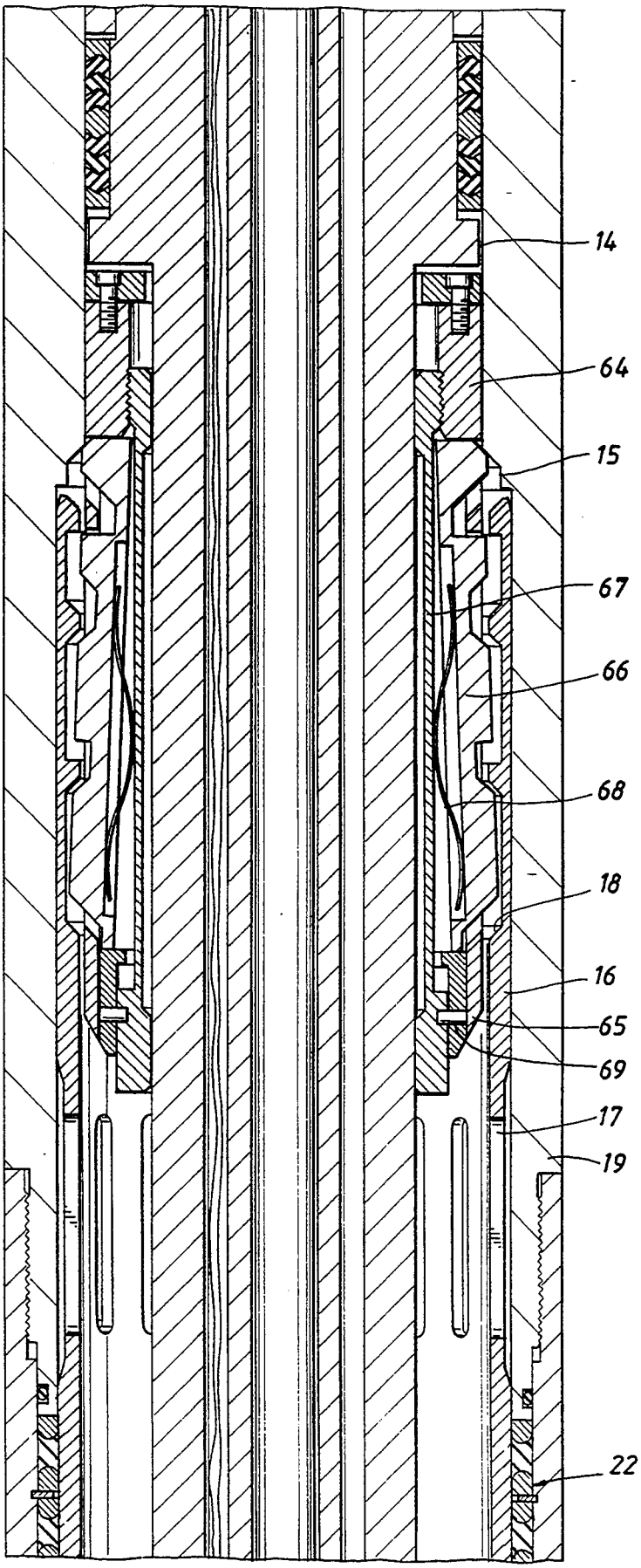

In FIG. 1E of the drawings, the string of production tubing in the well serially connects with a joint 11 in accordance with the present disclosure. A form of the joint 11 is shown in U.S. Pat. 3,051,243, particularly FIG. 6 thereof. The tubing is provided with a typical threaded connection 12 at the upper end so that it can be connected in the production tubing string. The tubing is within a casing with cement placed on the exterior to hold the casing in position to prevent external fluid communications along the exterior of the cased well. The casing is perforated to flow to a packer defined zone around the production tubing. The tubing has an anchor receptacle 13 which is preferably common to each tubing joint 11 that is included at the respective different zones or formations in the well borehole. The anchor receptacle 13 is profiled with appropriate lands and shoulders so that it receives a set of latch keys to be described. This common construction is included in every tubing string so that the sonde can connect with each and every similar mechanism below the receptacle 13. There is a cylindrical wall 14 which cooperates with a seal mechanism as will be described. In addition in FIG. 1F, the tubing 11 is provided with a thinner wall, a shoulder 15 defining a region of increased diameter so that a moveable sleeve 16 is slidably located at this region. It is shown at FIG. 1F at the top end of its range of movement. The moveable sleeve 16 is constructed with a number of slots 17 just below a unique latch receptacle 18. The receptacle 18 is unique to this particular installation and differs from all other installations in this particular well of there are three zones of interest, then each zone has its own receptacle 18 serially in its own production tubing string.

Figure 1G:
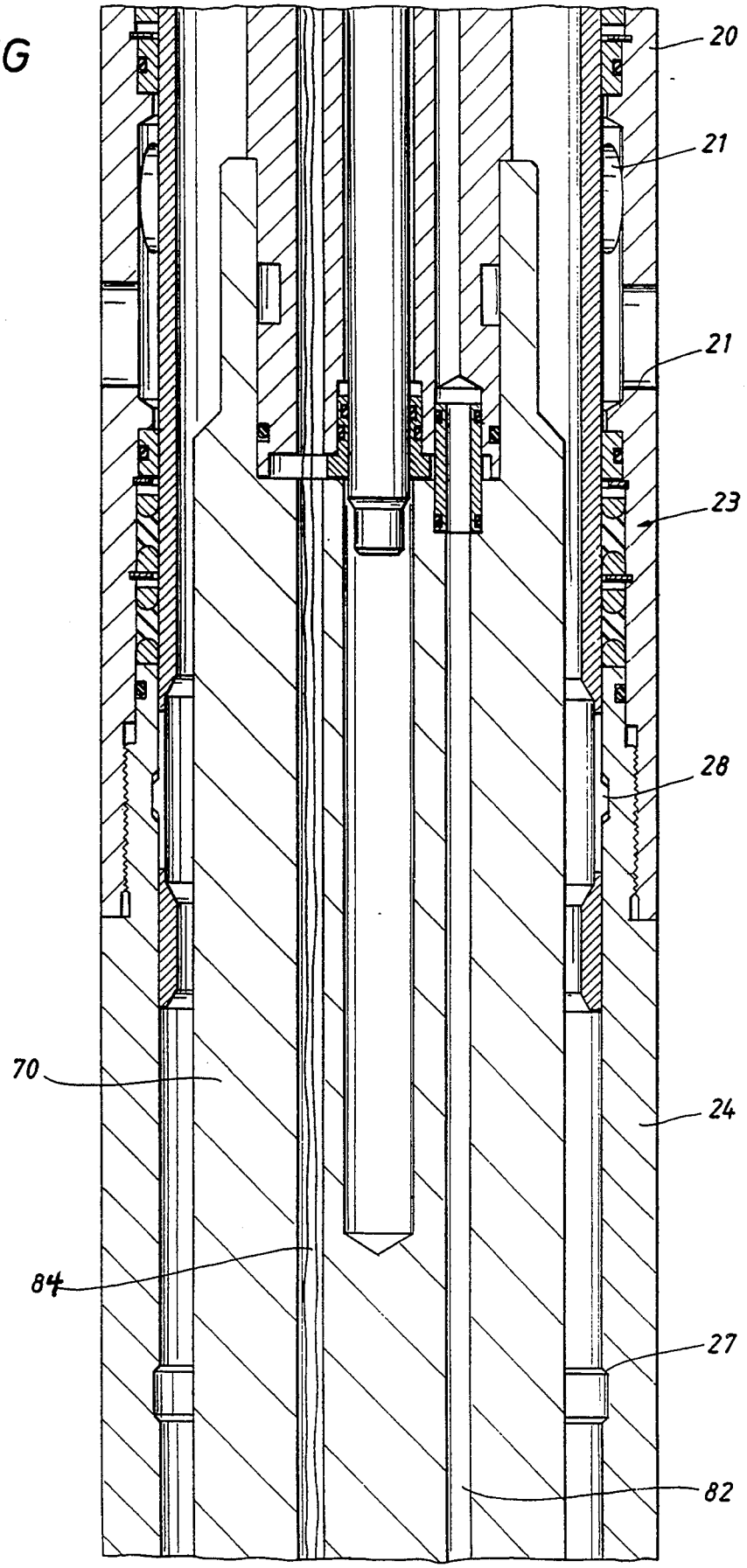
Figure 1H:
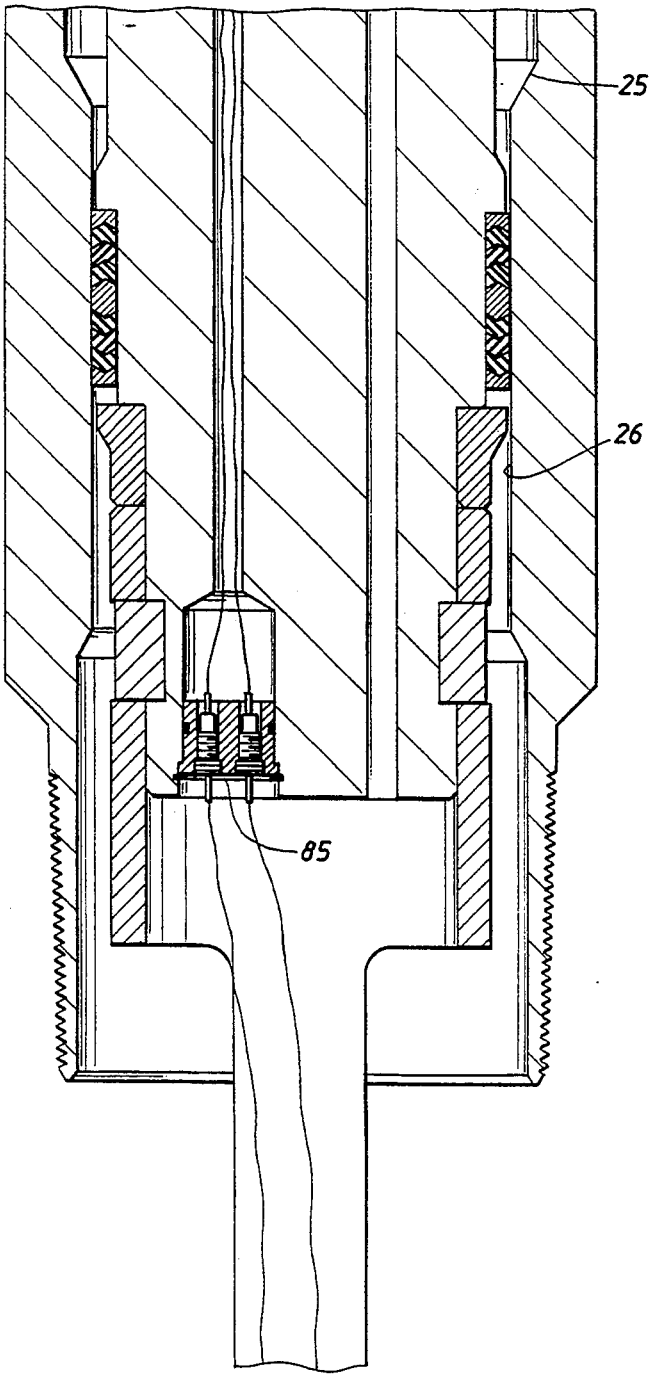
Figure 1I:
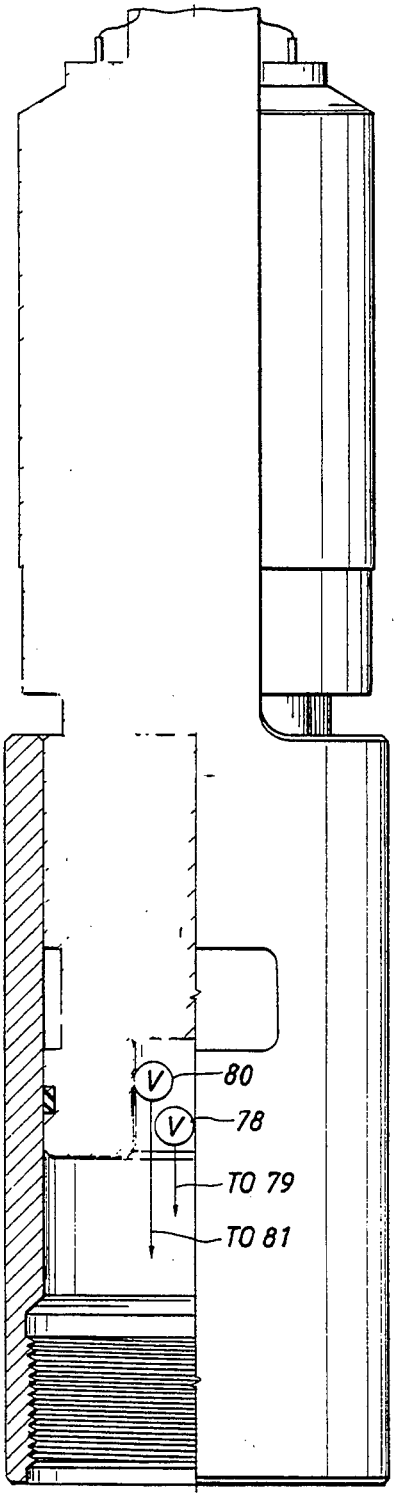
Figure 2A:
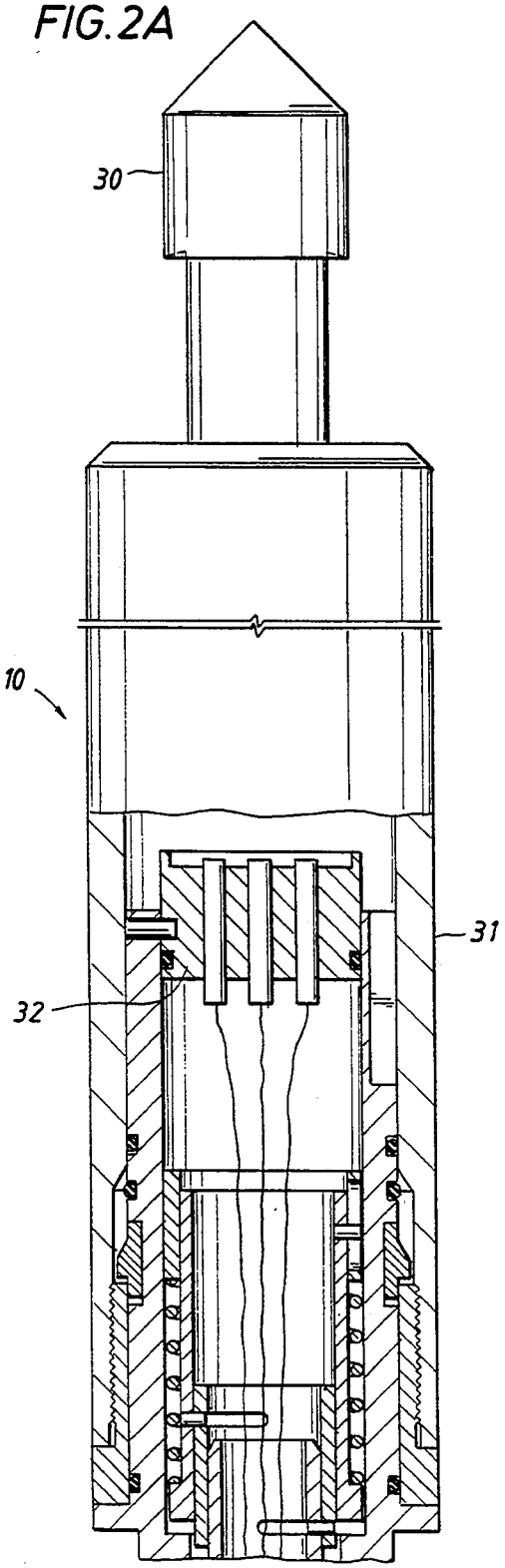
FIG. 2 (serial segments 2A, 2B, 2C, 2D, 2E, 2F, 2G, 2H and 2I) is a view similar to FIG. 1 showing the sonde accomplishing an anchored connection with the production tubing at the upper end by operation of latch keys inserting to an anchor receptacle, and also showing latch key insertion into a uniquely profiled latch and also showing latching connection with the moveable sleeve so that an electric motor extends an elongate member to force open the moveable sleeve and thereby permit production of formation fluid flow into an isolated control zone.
Figure 2B:
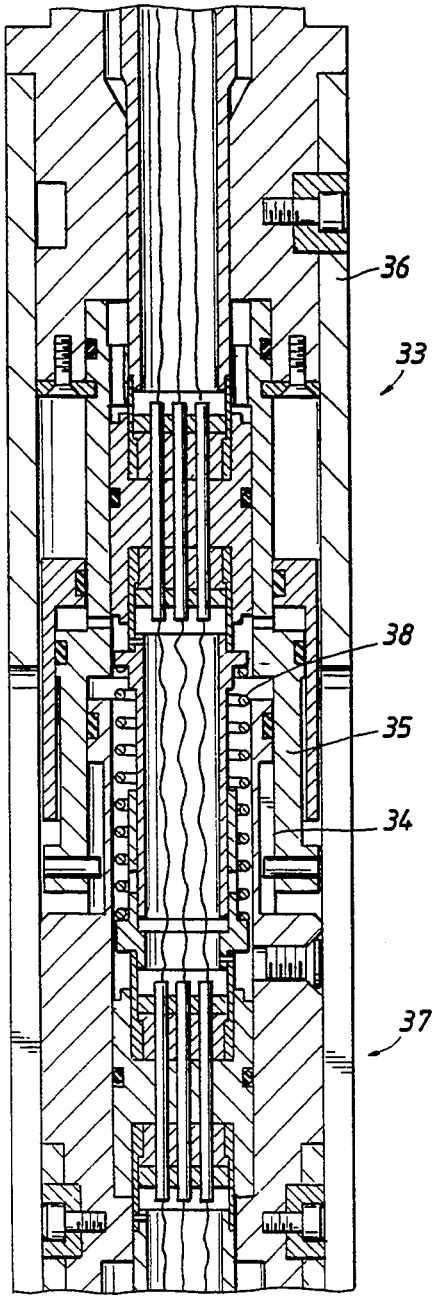
Figure 2C:
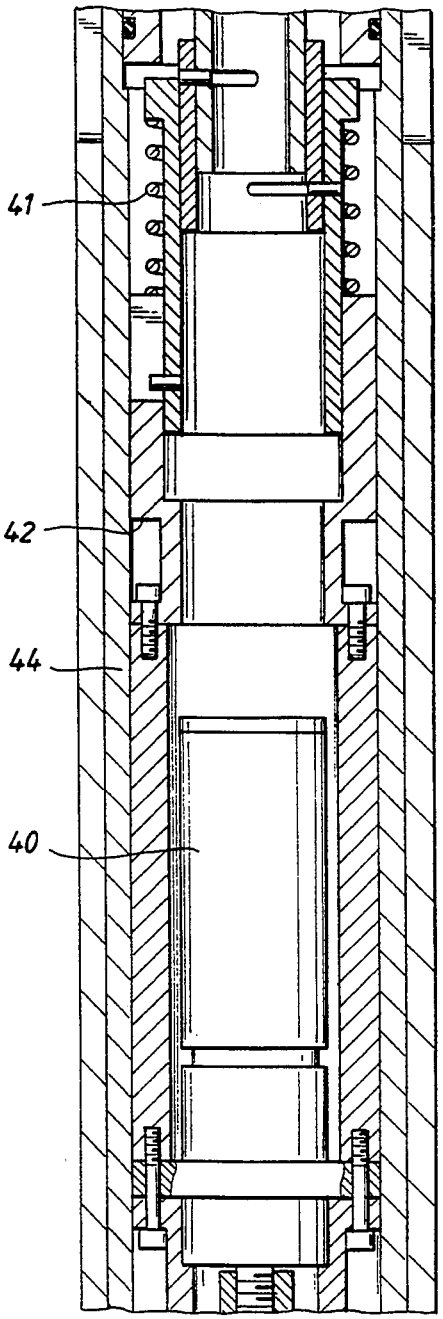
Figure 2D:
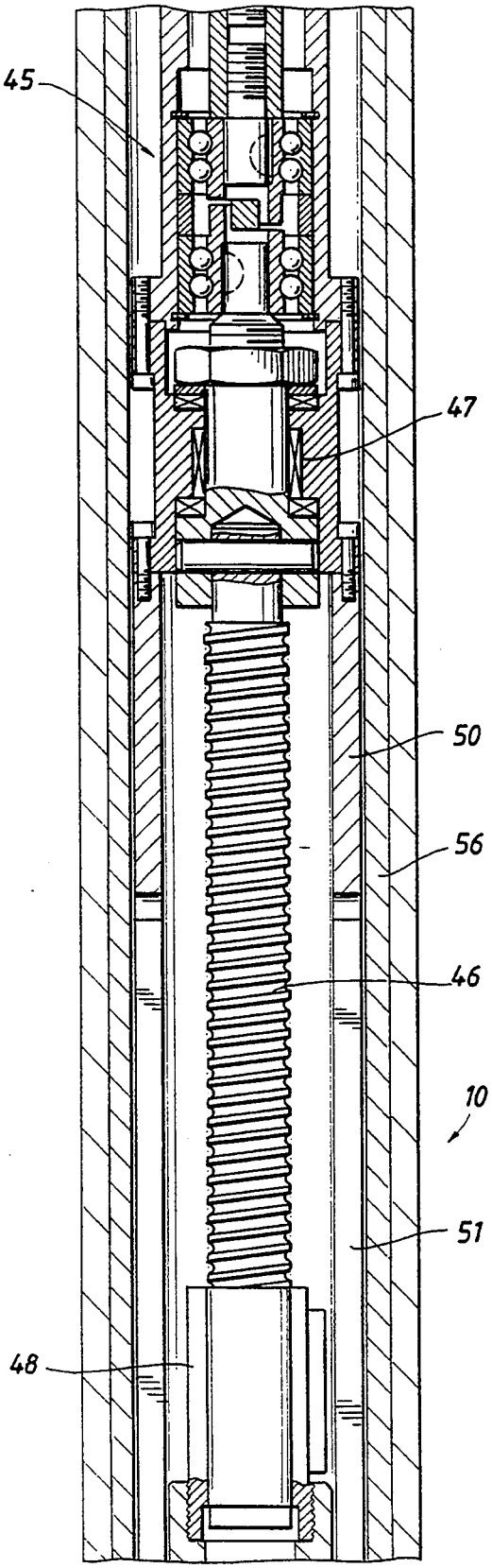
Figure 2E:
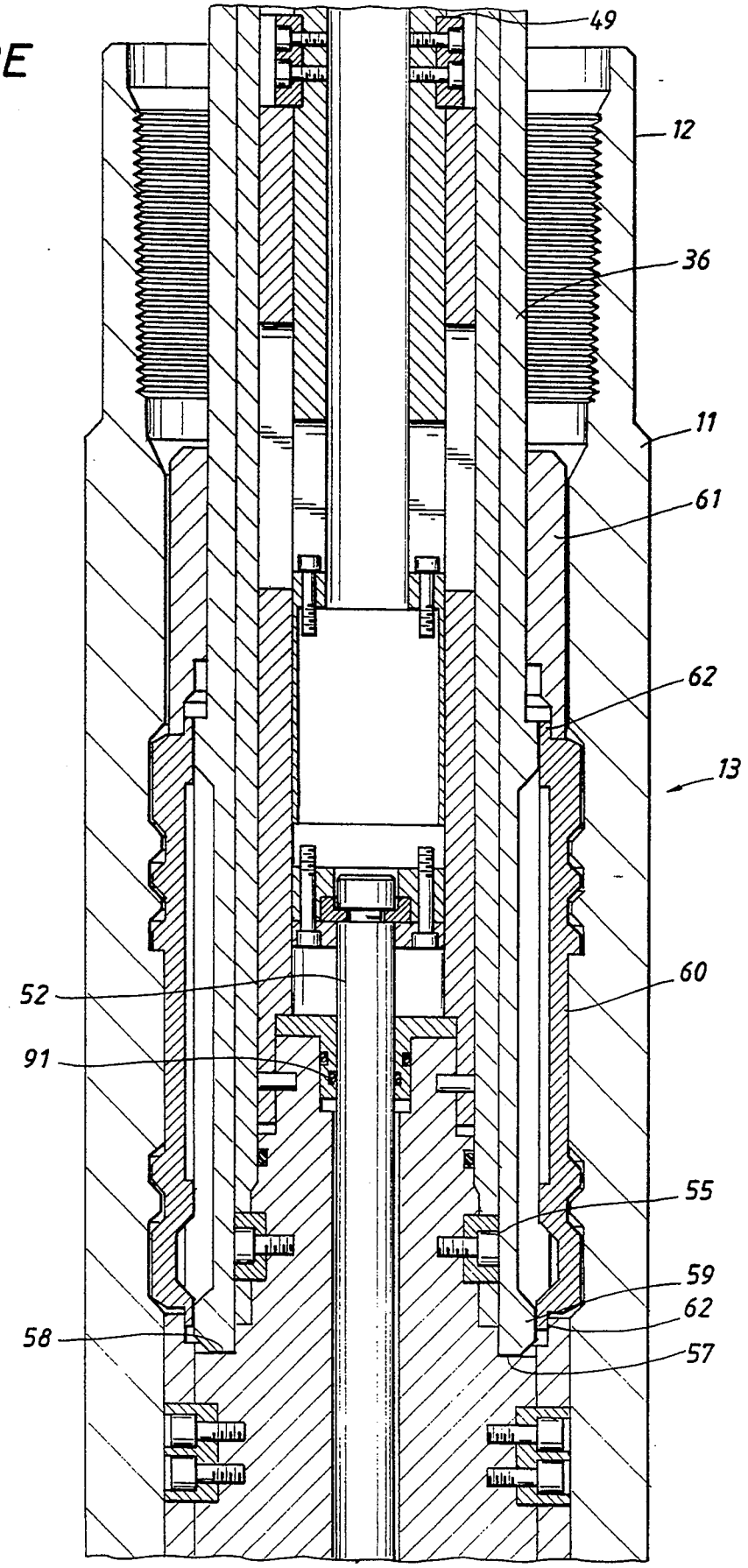
Figure 2F:
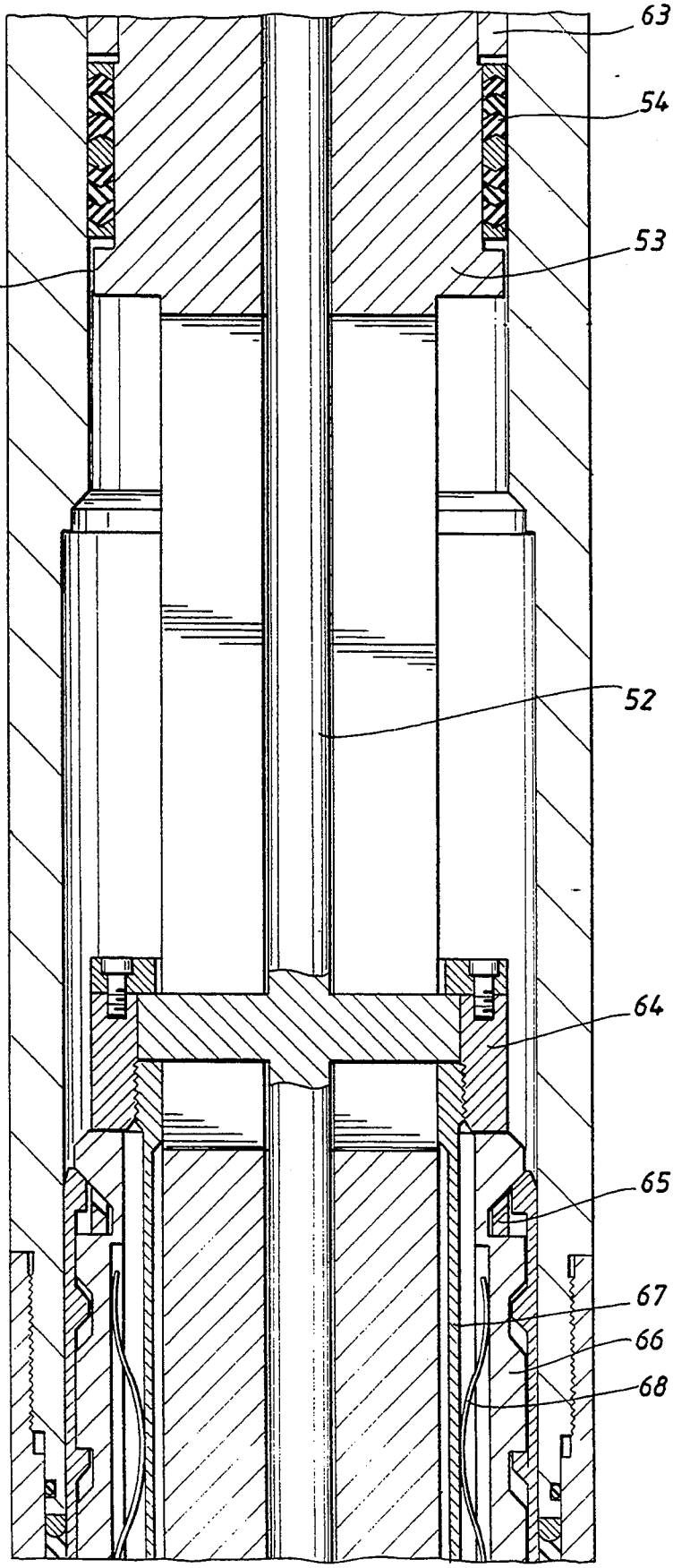
Figure 2G:
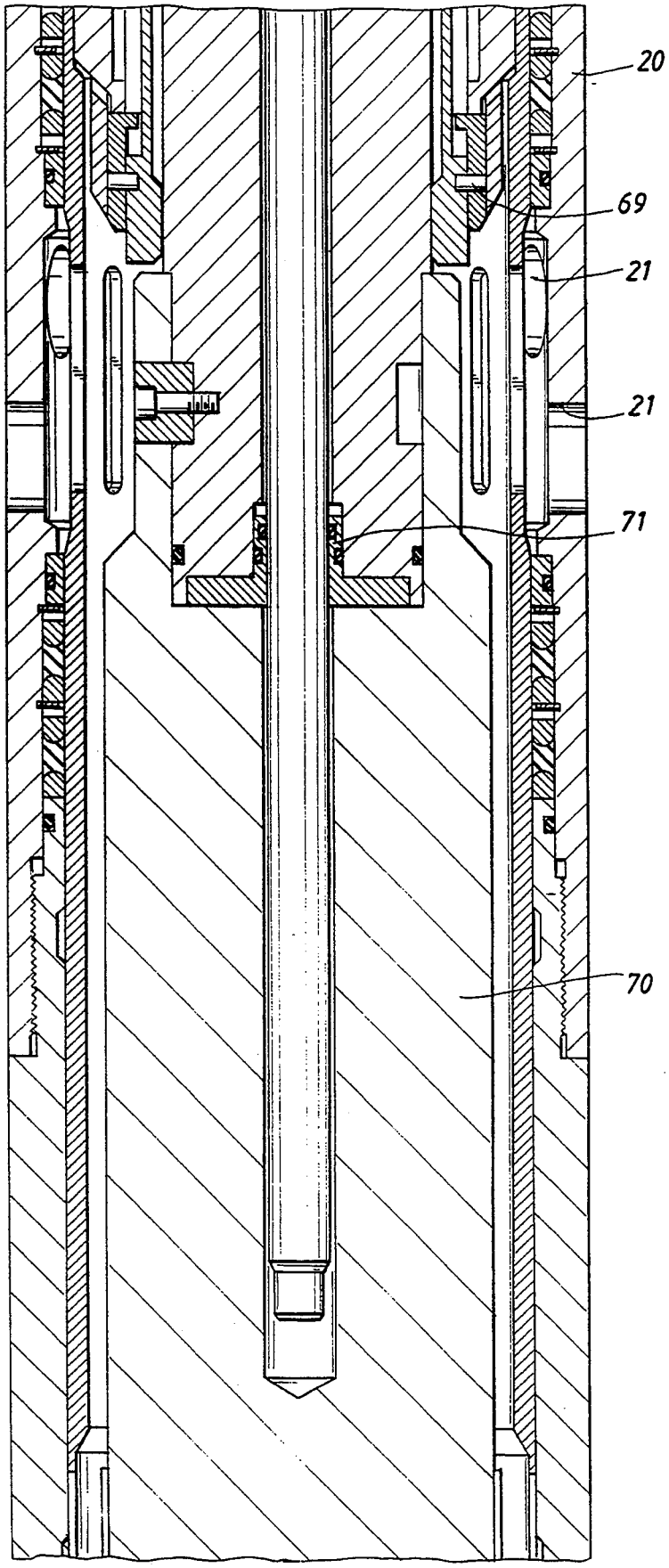

The numeral 19 identifies an upper segment or portion of the tubing string. It threads to another joint section at 20. The section 20 has a length appropriate to permit machined ports through it. In this instance, one port 21 is shown in FIG. 1G while additional ports at a different elevations are permitted. It is important that the ports be bracketed by seals above and below the group. This isolates the production. The section 20 terminates in the threaded connection with the upper section 19, and that is also repeated there below. Moreover, at the threaded joint, there is access to define a seal area where a set of seals 22 is installed. The seals 22 comprise suitable snap rings and packing seals. They are included to prevent leakage internally of the tubing string the moveable sleeve 16. As shown in FIG. 1 of the drawings, the moveable sleeve is in the up position and the fluid flow slots 17 in the sleeve are above the seal 22. The top seal 22 is duplicated by a similar, even identical seal 23 which is located below the ports. The seals 22 and 23 bracket the production flow on the exterior of the production tubing.

There may be only one but typically there are many ports 21 through the tubing section 20 into the formation. As appropriate, the ports are formed through the tubing and open into a packer defined region in the casing so that an adequate fluid flow is obtained. The tubing includes an additional section 24 which is similar to the section 19 just mentioned, and it extends downwardly with internal clearance for permitting travel of the moveable sleeve 16. The moveable sleeve 16 can move until its range of travel is limited at a shoulder 25. There is a cylindrical surface area 26 which receives and supports a cooperative seal ring on the sonde as will be described. Travel of the moveable sleeve 16 is limited by means of a shallow detent receptacle 27 which engages mating and matching detents 28 on the sleeve 16. The detent 28 is preferably formed between the respective ends of some lengthwise slots which define relatively thin wall fingers in the length of the sleeve. The slots are provided to control the stiffness and hence the resiliency of the detents 28. Moreover, these slots are not included for fluid communication; rather, they define a mechanism whereby latching can be obtained thereby assuring that the moveable sleeve 16 is held in the down position.

The foregoing apparatus is installed at each formation from which formation fluid flow is required. The tubing joint 11 to each formation normally has the same diameter and same length, and can be connected in a single or multiple tubing strings; if several joints 11 are connected to a single production tubing, each joint 11 must have some difference to avoid connection to the wrong joint 11. The receptacles are unique to avoid confusion. Any variation in formation thickness may change the spacing of the casing located packers on the exterior of the tubing string. The packers are spaced so that they bracket the formation perforations. Between the packers, the ports 21 and seals 22 and 23 are included so that the formation production fluid does not leak and thereby evade control of the moveable sleeve. The moveable sleeve has a range of travel which is shown by the spacing of the sleeve from the up position as shown in FIG. 1 to the down position shown in FIG. 2. A typical sleeve stroke is in the range of 7 inches. This range of travel is sufficient to move the slots 17 from above the seal 22 to a position where fluid communication from the ports 21 is achieved. Moreover, this movement enables the formation fluid flow to flow through the ports 21, into the narrow annular cavity surrounding the sleeve 16 and through the slots 17 to the interior of the tubing. In the up position, the moveable sleeve can be left in the closed and sealed position indefinitely. In the down position, fluid flow is permitted for the duration of the opening. The sleeve moves between the full open and the full closed position to establish well control. Key latching will be detailed later.

DETAILED DESCRIPTION OF THE SONDE

In FIG. 1 of the drawings, the sonde 10 will be described preceding from the top end. At the top end, there is a wire line cable head 30 having conductors to associated control electronics in a housing 31 which is broken away in partial sectional view to show the interior where a socket 32 supports a number of conductor feedthroughs for providing electrical power. The sonde 10 is supported on an electric wire line which connects to the industry standard cable head 30 for ease of retrieval. The conductors connect with the plug 32 thereby defining the requisite number of electrical conductor paths into the equipment. The several conductors extend from the plug 32 to a similar plug assembly 33 which comprises two plugs, feedthroughs, and a transverse bulkhead (see FIG. 1B). The bulkhead and plugs provide fluid isolation so that the conductors extend through this region but fluid flow is prevented in this area. As will be observed, the bulkhead assembly is a transverse seal mechanism across the sonde.

The components inside the sonde move relatively in a pressure compensated system. The conductors have some slack provided between the plug 32 and the bulkhead assembly 33, thereby permitted momentary elongation. An upstanding skirt 34 is aligned with an adjacent, telescoping hollow sleeve 35 which can slide downwardly by a specified distance, sliding movement being permitted by seals which prevent leakage to the interior. The sleeve 35 also connects with the structure thereabove and is fixedly attached to a slotted external sleeve 36 defining the housing. The sleeve 36 is the exterior structure, that is, the external shell or housing around the upper end of the sonde. The external pressure acting on this area compresses the electrically insulated oil in the sonde with the dotted line position of the sleeve shaped compensating piston being shown in FIG. 1B.

As mentioned above, the bulkhead 33 prevents fluid communication through the structure. That is duplicated again at 37. The two bulkhead members 33 and 37 including the various feedthroughs and electrical conductors are separated from one another by a specified distance, but that distance can shorten momentarily. Electrical contact closure results from a coil spring 38 which forces the two transverse bulkhead structures to a specified spacing. On jarring impact, the spring may be momentarily compressed in greater measure while it maintains the contact of the two connectors. The spring 38 assists in urging the electrical plug into the sockets at the bulkheads 33 and 37. The tool utilizes a number of electrical conductors which extend the length of the tool. Since they must pass through the separate compartments in the tool which are pressure isolated, the electrical plugs and sockets must be assured of continued connection. This is assured by spring loading the respective electrical plugs and sockets. The coil spring 38 provides a force which urges continued electrical connection so that there is no loss of connection on jarring impact. Should there be such impact, the components are urged toward the illustrated position by the spring 38 which assures this electrical continuity.

In that part of the sonde between the bulkhead members 33 and 37, the area is filled with an incompressible oil which is an incompressible nonconducting fluid. It is exposed to the pressure in the exterior of the sonde. Pressure is equalized to the external pressure which is accommodated by expansion of the chamber filled with oil between the bulkhead members 33 and 37, and this expansion is indicated by the dotted line position shown in FIG. 1B of the drawings whereby the chamber is enlarged or reduced in volume. By contrast the space in the tool between the bulkhead 33 and the top most plug 32 is filled with air. Because air is a compressible fluid, no effort is made to adjust in response to external pressure. As will be understood, appropriate seal mechanisms are included to isolate this chamber as well as the other chambers in the sonde. Downward travel of the bulkhead structure 37 is limited by its construction. The conductors extend through the bulkhead assembly 37 to an electric motor 40 (see FIG. 1C). The motor is provided with power from the conductors. There are certain signal conductors which extend below the motor 40 but they will be discussed in some detail hereinafter. The upper end of the sonde supports the motor 40 by a mechanism which includes the coil spring 41 which bears against a cylindrical motor mounting structure 42 to assure contact at the connectors. The motor 40 is on the interior of an elongate cylindrical motor housing 44. The motor housing 44 forms a sealed volume on the interior for the motor 40 which is located internally of the housing. The motor housing 44 is of substantial length, and terminates in a fashion which will be described in detail. For the moment, it is important to note that the motor 40 (see FIG. 1D) connects with an alignment and bearing assembly 47 which is provided for the purpose of connecting the motor with an elongate lead screw 46. It includes an extending shaft connected with the lead screw 46 for its operation. The lead screw is rotated so that a traveling nut 48 is advanced by the lead screw during rotation, moving downwardly of FIG. 1D. So that the nut 48 will move, it is necessary that the traveling nut incorporate a protruding tab 49 shown in FIGS. 2D and 2E of the drawings locked in a slot 51 of a cylindrical housing 50 which extends within the motor housing. Rotation of the screw under power of the motor 40 while preventing rotation of the traveling nut 48 which is constrained by the protruding tab 49 necessarily results in the linear movement of the traveling nut.

The traveling nut 48 forces an elongate member 52 downwardly in FIG. 1E. The traveling nut connects to the elongate member 52. In contrasting FIGS. 1 and 2, it will be observed that the upper end of the elongate member 52 is advanced by the length of travel of the traveling nut. The elongate member 52 is forced downwardly through an elongate central sub 53 (see FIG. 2F) which is anchored in position. The sub 53 supports an upper seal assembly 54 on the exterior. The sub 53 is fastened by a bolt 55 to a sleeve 56 (see FIGS. 2D and 2E) extending upwardly to the transverse bulkhead assembly 37. The upper end of the sleeve is fixed by bolts also at the upper end. On the exterior of the sleeve 56, the sleeve 36 is able to slide and move downwardly so that the lower most terminal shoulder 57 (on the sub 53) is permitted to travel to abut the shoulder 58 opposing the shoulder 57 (see FIG. 2E). While the range of travel need not be great, the shoulder 57 is immediately adjacent to an enlargement 59 (see FIG. 1E) which is part of the matching profile to seat the latch keys 60 radially outwardly to engage the mating and matching receptacle 13 which comprises the anchor mechanism.

In other words, downward shifting of this sleeve 36 by a short distance is accompanied by radial movement outwardly of the anchor latching mechanism which mates to or conforms with the facing receptacle 13 which is formed by machining the encircling receptacle profile in the tubing. Typically, the latch key mechanism comprises two or three latch keys which protrude through windows in a surrounding cage 61 which is included for the purpose of holding the latch keys in alignment. The latch keys 60 are fabricated with end and side locating lips or shoulders 62 to aid and assist in holding the keys in the respective cage windows. The keys 60 are forced radially outwardly by a spring beneath each key preferably a long leaf spring or a compressed coil spring acting radially outwardly against each key. The cage 61 terminates in a lower skirt which is bolted to the sub 53 in FIG. 2E above the seal 54 to assure locking the seal 54 in place.

Summarizing the operation of the tubular sleeves and associated components in the upper portion of the sonde, the outer sleeve 36 is able to telescope downwardly upon inertial upset, thereby cooperating with the latch key supported in the cage 61. The keys are radially urged outwardly, thereby fitting into the matching receptacle. So to speak, the sleeve 36 initially props the keys to enable latching motion. The tubular member 56 is fastened by the bolt 55 to the sub 53 and is the housing which surrounds the motor. The motor 40 rotates the screw 46 to advance the traveling nut 48 which is prevented from rotating by the slots 51 in the elongate sleeve 50 which is attached to the motor and thereby permits the tabs 49 extending into the slots 51 to guide the traveling nut during its lengthwise motion. This in turn advances the elongate member 52 which moves downwardly of the tool. It also is guided by an axial passage drilled in the center of the sub 53. The sub 53 is a solid member abutting a ring 64 (see FIG. 1F) advanced downwardly also. The ring 64 is driven by the elongate member 52, and also engages a key cage 65. The cage 65 supports two or three keys which protrude through cage windows, the keys being identified at 66. The respective keys 66 latch at the unique key receiving receptacle 18 at the top end of the moveable sleeve 16. The cage 65 is formed of an outer cylindrical body having the windows therein which permit the keys to extend through the windows, typical there being three keys with three mating windows. The cage 65 is pinned to an internal cage liner 67 beneath the keys which provides a gap or space for leaf springs 68 to force the keys radially outwardly. The liner 67 is fastened by a shear pin 69 (one or several) which is broken for reasons to be described in the event of an alternate approach for release is necessary.

The construction of this set of keys 66 in conjunction with the cage 65 which holds the keys is noteworthy. An important aspect is a means whereby the tool can be retrieved should there be a failure of the electric motor. If this failure occurs, it would be necessary to close the sleeve to prevent continued production while the sonde is freed from the engaged position. Pulling on the electric wireline will retrieve the sonde; if the line is parted, the sonde is retrieved by a fishing tool which engages the fishing neck. The upward pull on the tool requires that the moveable sleeve be pulled upwardly to close. If such a motor failure were to occur, upward pull on the sonde imparts upward motion to the sleeve 16 which is engaged by the keys at the receptacle 18. This would move the sleeve 18 upwardly from the down position of FIG. 2 to the up and closed position of FIG. 1. On movement in that fashion, the sleeve 16 travels upwardly to the limits of travel at the shoulder 15. This then transfers sufficient shearing stress to the shear pin 69 which breaks at a controlled load. On breaking the shear pin, the key 66 are then forced to move radially inwardly against the force of the spring 68 which forces the key outwardly to maintain it in the receptacle 18 in the latched position. The force of the spring 68 is then overcome.

This movement from the radially extended position shown in FIG. 1 of the drawings takes advantage of the fact that the angles on the several keys engaging the cage causes inward movement of the keys. Specifically, and viewing FIG. 2 of the drawings, this upward travel, after closing the sleeve 16, forces the liner 67 upwardly and ultimately into contact with the cage such that the cage over rides the lower edges of several keys 66 at a tapered or sloping face which permits the keys to ride under the cage, thereby moving radially inwardly towards the retracted position. This results in retraction of the several keys to the withdrawn position so that the keys can then slide internally of the shoulder 15, thereby reducing key diameter and permitting retrieval past the shoulder 15. In other words, the sleeve 16 is moved to the upper limits of its travel after which the keys are forced radially inwardly, reducing the diameter maintained by the keys and permitting retrieval, free of the key connection into the receptacle 18.

The elongate member 52 which moves downwardly positions the ring 64 to operate the latch keys as mentioned so that the receptacle is engaged. The profile of the receptacle in conjunction with the profile of the matching latch keys assures proper connection of the sonde to the particular moveable sleeve in the borehole which is to be operated thereby. Assuming that this connection has been made, it will be observed that downward travel of the elongate member 52 is accompanied by downward movement of the cage 65 and that movement is coupled through the latch keys 66 to the top end of the moveable sleeve 16. This assures that the sleeve 16 is forced downwardly, compare FIG. 1 with FIG. 2. This locates the slots 17 immediately adjacent to the ports 21 into the formation and in the zone between the seals 22 and 23. It does not matter that the seals 22 and 23 are quite far apart for example to bracket a set of ports. The ports 21 between the seal mechanisms 22 and 23 fill the region on the exterior of the moveable sleeve 16 with an accumulation of formation fluid flow which is drained when the slots 17 are positioned between the seal mechanisms 22 and 23. Accordingly, formation fluid flows into the annular area on the interior of the moveable sleeve 16 and is ultimately captured below the seal mechanism 54 previously described and a similar symmetrically located seal mechanism below telescoping sleeve 16.

Recall the sub 53 which is fixed to the sleeve 56. The sub 53 extends downwardly of the structure to a captured seal mechanism 71 adjacent to another sub 70 which extends the core of the structure. The sub 70 fits in the annular space on the interior of the moveable sleeve 16. The sleeve 16 is able to move downwardly around the sub 70 as shown in FIG. 2 of the drawings. The sub 70 includes a cylindrical area supporting an external seal 72 which is similar to the seal 54 previously mentioned. The seal 72 fits internally of a cylindrical surface which is part of the tubing joint to define a seal so that the present mechanism captures fluid in an isolated zone between the seals 54 and 72 on the interior of the tubing string. The seal 72 enables the sonde to operate as a plug preventing fluid flow in the cased well below the seal 72. The isolated zone between the seals 54 and 72 is permitted to fill with formation fluid flow. That fluid is then diverted into a passage 73 which has an opening on the exterior of the sub 70 for that purpose, and drains fluid downwardly into the passage 74. The passage 73 illustrated in FIG. 2 of the drawings is located as low as possible so that there is minimal fluid accumulated below it and above the seal 72. This location of the passage assures that substantially all the production fluid introduced through the port 21 and then into the slotted sleeve is retrieved within the sonde. For the moment, and assuming that the well is substantially vertical, the passage 73 is at the bottom of the fluid accumulation region. This directs the fluid into the passage 73 to flow downwardly. The gravity flow adds to the formation fluid drive which ordinarily forces the production fluid out of the formation in the first instance, and is typically sufficient to deliver the fluid into the passage 73 even should the passage 73 be located on the high side of the tool. In any event, the production flow is directed into the passage 73 and flows downwardly along the sonde in the internal passage 74. Flow continues to extend through the passage 74 which extends downwardly to a manifold sub 77 which supports the valves and control valve mechanisms. One of the valves 78 connects with a first chamber or container 79 while another valve 80 connects with a container 81. The container 79 and 81 serve purposes to be described. When the valves 78 and 80 are switched appropriately, formation fluid flow is delivered to either the container 79 or the container 81. Recalling that FIG. 2 is a sectional view through the sonde taken at right angles to the sectional view through the sonde in FIG. 1, the lower portions of the sonde include several different passages. The passage 74 just mentioned is the pathway for delivery of production fluid downwardly for storage. In FIG. 1 of the drawings, an upwardly directed passage 82 is also included. It is a pressure equalization passage. If the sonde is being placed in a tubing string which is filled with liquid and is required to seat in seals in the tubing joint, this movement requires the sonde to be inserted in liquid in the same fashion as placing a cork in a bottle. Since the liquid is incompressible, and since the sonde is being forced into a seal, pressure relief across the sonde must be provided. The passage 82 opens from the lower end of the tool to provide such pressure relief. The passage 82 is therefore open at the bottom end, thereby defining the pressure relief pathway. This passage 82 continues through the serially connected sub components 70 and 53 to deliver fluid flow to the top of the sonde. The passage 82 enables any trapped liquid to flow upwardly when the sonde is moving downwardly in the tubing string. It permits liquid trapped above the sonde to flow downwardly through the sonde when the sonde is being pulled upwardly in the tubing string. The passage 82 opens to the exterior at the upper end of the passage 82 above the seals, thus spanning the seals.

Parallel to the passage 82, there is also a passage 84 which is for the electrical conductors extending through the lower sub components 53 and 70. The passage 84 provides a route for wiring and connects with the plug 85, thereby routing the electrical conductors to the control for operation of the valves. The passage 84 is sealed and closed and therefore can be at atmospheric pressure.

EXAMPLES OF OPERATION

Assume that a well has been drilled to a substantial depth that passes through three zones of production. Depending on the age of production, the fluid pressure drives in the zones, and a number of other factors, it may be appropriate to produce all three of the zones, especially the production may occur simultaneously or at different times from different zones. The well operator will select an operation sequence for the respective zones. Under this assumption, the well is initially cased and the casing is cemented in place in the ordinary fashion. This procedure is applied without regard to the angular orientation of the well with respect to the zones. That is, the well can be substantially vertical as might occur at typical land well locations, or the well can be highly deviated as might occur when the well is drilled from an offshore platform where it extends more or less vertically for a portion of its length, then extends at an extreme angle, and then terminates in a formation vertical portion. In any case, the well is cased and cemented to the appropriate depth. At the respective producing formations, perforations are then formed which communicate the formations into the cased well. At the lower most formation, the apparatus shown in the drawings of this disclosure is installed at the lower end of the production tubing string. Through the use of upper and lower packers, a production zone is isolated which brackets the perforations, and the tubing string is located in the production zone defined by the packers. In particular, the tubing structure of the present disclosure is installed with one or more ports 21 located to drain production fluid from the packed off area in the casing into the production tubing string at the joint 11. Thus, flow is delivered into the production tubing string through the valving mechanism of the present disclosure. As detailed above, the moveable sleeve is used to control the operation of the valve so that it is opened or closed and under control of the operator from the surface. The equipment is thus installed and typically is closed so that there is no production flow from the formation into the cased well and the numerous ports 21 into the production tubing string. That flow is permitted only when the moveable sleeve 16 is pulled to a location which clears the port for production.

In like fashion, production tubing and the joints 11 are installed for the second and third formations. At each formation, perforations again are isolated by upper and lower packers, and that particular production zone, with packer isolation, is communicated with the tubing string at the joint 11. Again, the joint 11 of the present invention is installed so that a moveable sleeve is located at each and every one of the production zones. Preferably, the production tubing and joints 11 are uniquely isolated from one another so that there is no chance of fluid flow out of one production zone into a lower pressure zone. In that sense, each formation can produce as though it were the only formation communicating into the cased well.

At an appropriate time, production is initiated from one of the designated production zones. At that time, the sonde of the present disclosure is lowered through the production tubing string to that particular production formation. The moveable sleeve is moved from the closed to the open position. This requires that the sonde is first anchored and then connected with the moveable sleeve. Both the steps of anchoring and connecting positively to the moveable sleeve require the keys to operate as mentioned in detail in this disclosure. The two sets of keys on the sonde uniquely connect the sonde so that it is anchored and yet is able to connect with and move the sleeve, thereby utilizing the anchored sonde for extension of the elongate member. The elongate member is extended, thereby positively engaging the moveable sleeve, and with continued extension, the sleeve is moved from the closed to the open position.

When this occurs such movement shifts the moveable sleeve from the fully closed position to the fully open position. It is possible then to obtain fluid production from the formation into the packed off zone of the casing (surrounding the tubing string) and then through the tubing string at the ports 21 as mentioned. When the flow is introduced to the interior of the production tubing string through the ports 21 as discussed, the fluid flow is isolated above and below by the seal members 22 and 23. That aids in isolating the production zone when the moveable sleeve is later closed. After it has been opened, the production fluid would otherwise flow along the production tubing string were the area not plugged by the sonde. The sonde acts as a plug when the seals on the exterior seat in the conforming sealing surfaces located above and below the moveable sleeve.

When a formation is produced, the sleeve 16 is open for a number of days or weeks. Sooner or later, it can be closed. When closed, the position of the sleeve is reversed by operation of the sonde as mentioned.

Two or three modifications of the procedure can be considered. Assume for purposes of description that it is desirable to obtain a carefully collected sample of the fluid produced from a particular formation. So to speak, there will be a first flow which is delivered into the sonde of the present invention and is captured. It is captured or collected in a first chamber and can be designated as waste products. This may be especially desirable in the event that the waste materials ought to be captured and retrieved for assured disposal. Otherwise, pollution difficulties might arise. Accordingly, the apparatus is installed by moving the sonde to the requisite location in connection with and adjacent to the moveable sleeve. At this juncture, the tubing above and below the ports 21 is plugged internally by the sonde. The collectible waste is diverted to the first chamber by operation of the valves previously mentioned. The equipment is provided with a second storage chamber which collects the desired sample of production fluid. That chamber enables collection of the fluid for testing purposes. In effect, it is the virgin fluid which is produced into the production tubing string. The risk of commingling this production fluid with other fluids which might be in the production tubing are substantially nil. This isolation protocol enables clear delineation between the initial production and the sample production so that the initial production can be treated as a prospectively tainted sample, and it can be therefore quarantined into a waste chamber or container on the sonde.

After production has been completed, the sonde can then be disconnected and removed. The next step is to move the moveable sleeve from the open to the closed position. Once that has been accomplished, only a small quantity of production fluid will remain uncaptured in the production tubing string and yet located in the region where the ports 21 are located. Since this is fluid which was caught on the interior of the production tubing string and which yet may represent something of a trace pollutant, it might be appropriate in many circumstances to operate the sonde so that this last remnant of fluid on the interior of the production tubing string is produced through the sonde and captured in the waste container. Thereafter, the sonde is removed simply by retrieving it after disconnection from the moveable sleeve. On retrieval, the sonde will then have waste fluid in the waste container. It will have two commingled slugs of fluid, the first from before opening the moveable sleeve and the last coming after closing the moveable sleeve. Pressure isolation of parts of the system should be noted. It should be noted that the motor is required to move the extending elongate member, and the system assures that this movement is accomplished without encountering a buildup of pressure. If this were to occur, the ambient pressure in the well could be sufficiently high that the elongate member could not be extended. Elaborating on this, the elongate member 52 is extended in its operation. The seal 71 provides pressure isolation of the end of the elongate member from the central region. There is also pressure isolation by the incorporation of an additional seal 91. The region between the seals 71 and 91 can be at any pressure while the regions below the seal 71 and above the seal 91 are at atmospheric pressure. The seals 71 and 91 surround two elongate cylindrical members which have the same cross sectional area. The areas are the same to avoid creating an area differential which exposed to a pressure creating an impediment to extension or retraction. That is to say, the seals 71 and 91 capture a high pressure zone between them without prevent extension or retraction of the elongate member.

ADVANTAGES OF THE LATCH AND RECEPTACLE SYSTEM

As noted, the sonde when placed in the well is equipped and constructed so that it will not latch at the wrong elevation. It is necessary for the sonde to anchor at two places for a given formation. It is required to latch at one location to serve as an anchor. Secondly, and more uniquely, latching is accomplished so that the sonde is connected to the sleeve without ambiguity. It is anticipated that the anchor receptacle will be identical for every sleeve, but the receptacle in every sleeve will be different from and not compatible with the receptacles in other sleeves.

As a result of this construction, when the sonde is descending in to the well, the anchor keys 60 and the latching key 66 are urged outwardly by lief springs beneath the keys. In that sense, they are armed and ready for latching. The anchor keys are able to pass through many receptacles, even where they are duplicate because they equipped with angled shoulders which permit the anchor keys to slide into their respective receptacles and also to slide out. Careful review of the receptacle and the movable sleeve 16 will show that it has square shoulders, and the keys 66 also have conforming square shoulders. If the keys 66 match up with the particular receptacle in a particular sleeve, entry is achieved, and entry at another location is obviously not permitted because the receptacles are made uniquely for each particular sleeve. When the unique set of keys 66 then mate with the uniquely matching receptacle, the keys move outwardly, lock in place, and stop further downward movement of the sonde 10. On halting the sonde, and holding the sonde stationary, the sleeve 36 is then moved downwardly and takes the position for wedging action behind the keys 60 at their respective receptacle 13. Once the sleeve 36 is moved in this fashion, the anchor is locked in the particular location. This sequence of events then assuredly locks the latching keys both at the movable sleeve and also at the anchor location so that the sonde is anchored, and therefore is able to hold a fixed location. At that time, the anchored sonde, being fixed in location, is prepared to operate wherein the sleeve is positively forced from the closed to the open state. As will be understood, movement from the closed to the open condition is accomplished without jarring. This is used to advantage in the preliminary steps for anchoring the system and also in the steps involved in release. At the time of removal of the sonde from the well, the keys 66 retract under normal operation. As the motor 40 powers the elongate member 52 in upward motion, the upper angled shoulder of the keys 66 contacts the coaxing angled shoulder at the receptacle and subsequent upward travel of the elongate member forces the keys 66 inwardly to thereby release the keys from the movable sleeve 16. This restores the sleeve 16 to its closed position, note FIG. 1. Further, the keys are then disengaged for easy removal of the sonde from the location.

While the foregoing is directed to the preferred embodiment, the scope thereof is determined by the claims which follow:

We claim:

1. A method of producing formation fluid into a well penetrating at least two different formations comprising the steps of:

(a) placing a casing in a well borehole through at least two different formations;

(b) forming fluid producing perforations into the different formations opening into the cased well borehole;

(c) positioning at each formation a moveable sleeve in a position to close off formation fluid flow so that formation fluid flow is prevented from flow or is permitted to flow wherein the sleeve cooperates with means blocking formation fluid flow so that flow control is subject to the sleeve;

(d) positioning a unique key receiving means associated with each of said moveable sleeves;

(e) running in the well borehole an elongate sonde having a unique key fitting in one of said key receiving means to connect said sonde in the well borehole;

(f) moving axially of said sonde a sleeve engaging means to engage said moveable sleeve and push said sleeve to a position opening the sleeve to enable formation fluid flow therefrom;

(g) permitting formation fluid flow to continue until a desired amount of formation fluid flow has occurred;

(h) moving the sleeve engaging means to move the sleeve to the position closing the sleeve to prevent formation fluid flow; and (i) moving the sonde from the unique key receiving means by movement along the well borehole.

2. The method of claim 1 including the additional steps of:

(a) positioning upper and lower seal means in the well borehole to define an isolated zone at the moveable sleeve so that formation fluid flow is confined in the isolated zone;

(b) removing all fluid from the isolated zone prior to opening the moveable sleeve;

(c) then, opening the moveable sleeve by moving the sleeve to an open position so that fluid flow is permitted from the formation perforations;

(d) producing formation fluid flow until a desired quantity is produced; and (e) closing the moveable sleeve so that formation fluid cannot flow into the isolated zone.

3. The method of claim 2 including the following additional steps:

(f) removing the upper and lower seal means defining the isolated zone; and (g) moving the sonde along the well borehole for retrieval.

4. The method of claim 2 including the step of directing all fluid removed from the isolated zone into a sonde supported storage container.

5. The method of claim 2 including the step of capturing the desired quantity of fluid in a sonde supported storage container.

6. The method of claim 2 wherein said sonde has a waste fluid container and a produced fluid container, and including the step of placing the fluid initially in the isolated zone in the waste fluid container; and after opening the moveable sleeve, placing the produced fluid in the produced fluid container.

7. The method of claim 1 including the step of positioning a sonde container on the sonde prior to positioning the sonde in the well borehole; and then retrieving the sonde from the well borehole with formation fluid in the sonde container, and leaving essentially no formation fluid in the well borehole after retrieving the sonde from the well borehole.

8. The method of claim 7 including the step of placing all formation fluid in the sonde container in the isolated zone before and also after opening the moveable sleeve.

9. The method of claim 8 including the preliminary step of anchoring the sonde in the cased well.

10. A method of controlling fluid flows from a formation comprising the steps of:

(a) extending a well borehole through a formation;

(b) placing a casing in the well borehole extending there along to isolate the formation from the well borehole;

(c) perforating through the casing into the formation to enable formation fluid flow into the cased well;

(d) positioning a sealed moveable sleeve at the perforations to define a means enabling formation fluid production dependent on opening and closing the moveable sleeve;

(e) temporarily anchoring a sonde in proximity of said moveable sleeve;

(f) extending a sonde supported, elongate means to engage the moveable sleeve so that the moveable sleeve is moved thereby to an open position and thereafter to a closed position so that formation fluid flow is controlled thereby; and (g) forming a plug means in the well borehole with the sonde adjacent to the moveable sleeve so that formation fluid flow is confined by the plug means so that fluid flow is directed along a sonde defined passage.

11. The method of claim 10 including the step of anchoring the sonde in the well borehole by:

(a) engaging a profiled key on the sonde with a matching and mating key receptacle latching mechanism proximate to said moveable sleeve on moving the sonde along the well borehole;

(b) forming an enable signal after the profiled key engages the receptacle;

(c) responsive to the enable signal, forming a motor drive current to a motor in the sonde to extend the elongate means so that the moveable sleeve is moved to the open position;

(d) sensing full opening of the moveable sleeve to end the motor drive current to leave the moveable sleeve open for a selected interval;

(e) closing the moveable sleeve by movement of the elongate means in response to motor drive current; and (f) alternately closing the moveable sleeve by pulling up the well borehole on a line connected to the sonde so that the elongate means is moved during pulling, and said sleeve is moved thereby.

12. The method of claim 11 wherein said elongate means is releasably connected to said moveable sleeve during opening thereof and remains connected thereto until the moveable sleeve moves to the fully closed position and only then releasing the connection between the elongate means and the moveable sleeve.

13. The method of claim 12 including the step of pulling the sonde to close the moveable sleeve, and then releasing the sonde from the temporary anchor in proximity to the moveable sleeve.

14. The preliminary steps incorporated with the method of claim 13 including locating upper and lower seals in the well borehole above and below the moveable sleeve so that an isolated zone is defined thereby and including the step of forming a plug means;

also, preliminary to opening the moveable sleeve, forming a drainage passage from the isolated zone to remove any fluid in the isolated zone; and prior to removal of the sonde, after closing the moveable sleeve, again draining the isolated zone to remove any fluid therefrom by the drainage passage.

15. The method of claim 10 wherein the step of positively engaging the elongate means with the moveable sleeve for downward movement.

16. The method of claim 15 including the step of continuing the positive engagement until the moveable sleeve is opened and closed.

17. The method of claim 16 wherein the positive engagement ends with full closing movement of the moveable sleeve.

18. A method of opening and closing a moveable sleeve in a cased well borehole to start and stop formation fluid production comprising the steps of:

(a) lowering a sonde in the cased well borehole;

(b) positively anchoring the sonde in the well borehole in proximity of the moveable sleeve by sliding a sleeve means downwardly of the sonde to a shifted position;

(c) after the sleeve means is in the shifted position, then extending an elongate means from the sonde to push the moveable sleeve downwardly from a closed position to an open position wherein sleeve movement is moved between defined positions;

(d) directing formation fluid from the moveable sleeve solely through a passage in the sonde where flow is controlled by a sonde supported valve means;

(e) after fluid flow has extended for a selected interval, then stopping fluid flow by said valve means;

(f) moving the moveable sleeve from the open position to the closed position so that formation flow may no longer flow;

(g) then, releasing the anchored sonde by moving the sleeve means upwardly from the shifted position; and (h) pulling the sonde away from proximity to the moveable sleeve.

19. The method of claim 18 wherein the sleeve is axially moveable along the well borehole and including the steps of forming upper and lower seal means externally of said sonde to prevent formation fluid flow beyond an isolated zone between the upper and lower seal means.

20. The method of claim 19 wherein the moveable sleeve is adjacent to upper and lower encircling cylindrical surfaces and including the step of positioning appropriately spaced seal rings on the sonde; and aligning the seal rings with the cylindrical surfaces to form seals means.

21. The method of claim 20 including the preliminary step of positioning a receiving means a spaced distance above the moveable sleeve and placing a latch means uniquely fitting the receiving means on the sonde;

after positioning the sonde in the well borehole, then moving the latch means into an engaging position for said receiving means to ascertain latching at that moveable sleeve;

then positively anchoring the sonde in the well borehole as stated at step 18(*b*); and after releasing the anchored sonde by moving the sleeve means upwardly, then moving the latch means and said sonde from the moveable sleeve.

22. The method of claim 21 including the step of lowering the sonde in the well borehole on an electric line to provide electric power, and including the step of providing electric power to operate a motor to extend the elongate means, and later, operating the motor to retract the elongate means.

23. The method of claim 22 wherein the elongate means is connected to the moveable sleeve to enable sleeve movement, and is disconnected after the sleeve is moved to the closed position.

24. The method of claim 23 wherein the elongate means is positively connected to the moveable sleeve prior to movement of the sleeve and is released therefrom after movement ends.

25. The method of claim 24 wherein the positive connection is made by moving radially outwardly a set of locking keys in a moveable sleeve receptacle.

26. The method of claim 18 including the step of operating the valve means to open a selected fluid container.

27. Apparatus for controlling formation fluid flow from a formation flowing into a well borehole through perforations wherein fluid flow is permitted by an open moveable sleeve and is prevented on closing the moveable sleeve, the apparatus comprising:

(a) an elongate sonde;

(b) latching means for anchoring and holding said sonde in a well borehole at a location spanning a moveable sleeve;

(c) elongate means supported by said sonde for selectively extending axially of the well borehole to engage the moveable sleeve to move the sleeve by extending wherein movement opens the moveable sleeve and thereby enables formation fluid flow through the moveable sleeve;

(d) seal means supported by said sonde for directing fluid flow into an isolated zone at the moveable sleeve in the well borehole;

(e) passage means opening into the isolated zone to form a fluid flow path through said sonde; and (f) valve means in said passage means to control fluid flow therethrough so that fluid flow through said passage means from the isolated zone.

28. The apparatus of claim 27 further including an elongate latching sleeve means supported on said sonde moveable downwardly on said sonde, said latching sleeve means having a surrounding lower shoulder means engaging a radially moveable lock means for movement radially outwardly to lock with and hold in a matching and mating receptacle in the well borehole in proximity of the moveable sleeve.

29. The apparatus of claim 28 wherein said lock means comprises at least a pair of radially outwardly facing elongate members having protruding undercut lock shoulders cooperative with edges of windows in a surrounding cage, said pair of elongate members having a window exposed face with locking ridges and faces for locking, and also wherein said locking shoulders and said windows enable radially outward movement so that locking in the well borehole occurs with said shoulder means forcing said elongate members through said window for locking.

30. Well control apparatus comprising:

(a) valve means having (1) an open position;

(2) a closed position;

(3) means mounting said valve means internally of a cased well borehole to control fluid production from a fluid producing formation into the cased well borehole so that said valve means comprises the sole means enabling fluid production into the borehole; and (b) a wireline supported sonde for positively engaging said valve means to open or close said valve means, said sonde including (1) a sonde body;

(2) an elongate member extending from said body;

(3) means for positively engaging said valve means on said elongate member; and (4) motor means in said body for operating said elongate member for extension thereof so that said engaging means is positively engaged with said valve means to enable moving said valve means between positions.

31. The apparatus of claim 30 wherein said valve means comprises an elongate tubular member, upper and lower seals within said tubular member, a concentric cylindrical hollow moveable sleeve sealingly contacted against said seals and said sleeve further having an open position and closed position wherein the closed position is in contact with both of said seals, and said open position is achieved on movement of said sleeve so that openings in said sleeve are aligned between said seals.

32. The apparatus of claim 31 wherein said sonde incorporates an opening in said sonde adapted to be aligned with said valve means for providing a fluid flow path into said opening and said opening connects with a passage extending along a portion of said sonde to direct fluid flow along said passage to flow out of said sonde.

33. The apparatus of claim 32 wherein said passage extends to the lower end of said sonde and is switched by a storage container valve means between first and second storage containers at the lower end of said sonde.

34. The apparatus of claim 33 wherein said valve means comprises:

(a) a first valve to said first container; and (b) a second valve to said second container.

35. The apparatus of claim 30 wherein said motor means controllably moves said elongate member.

36. The apparatus of claim 32 wherein said passage provides a fluid flow pathway from the production formation to a place in a production tubing string below said sonde.

37. The apparatus of claim 30 wherein said motor means comprises a motor relatively rotating said elongate member with respect to a traveling nut threaded thereto for linear movement on extension.

* * * * *